US006926591B2

(12) United States Patent
Horsky et al.

(10) Patent No.: US 6,926,591 B2
(45) Date of Patent: Aug. 9, 2005

(54) MULTI-PURPOSE MACHINE

(75) Inventors: Anton Horsky, Wangen (DE); Paul Dieter Scharpf, Schlat (DE); Wolf-Dietrich Voss, Boll (DE)

(73) Assignee: Boehringer Werkzeugmaschinen GmbH, Goppingen (DE)

( * ) Notice: Subject to any disclaimer, the term of this patent is extended or adjusted under 35 U.S.C. 154(b) by 36 days.

(21) Appl. No.: 10/381,584

(22) PCT Filed: Oct. 23, 2001

(86) PCT No.: PCT/EP01/12247

§ 371 (c)(1),
(2), (4) Date: Jun. 30, 2003

(87) PCT Pub. No.: WO02/34466

PCT Pub. Date: May 2, 2002

(65) Prior Publication Data

US 2004/0023600 A1 Feb. 5, 2004

(30) Foreign Application Priority Data

Oct. 23, 2000 (DE) ..... 100 52 443

(51) Int. Cl.[7] ..... B24B 7/30

(52) U.S. Cl. ..... 451/49; 451/62; 451/246; 451/251; 451/399

(58) Field of Search ..... 451/49, 246, 251, 451/62, 385, 398, 399

(56) References Cited

U.S. PATENT DOCUMENTS

| | | | | |
|---|---|---|---|---|
| 3,352,065 A | 11/1967 | Enkelmann | ..... | 51/105 |
| 5,681,208 A | 10/1997 | Junker | ..... | 451/49 |
| 6,334,806 B1 * | 1/2002 | Sano et al. | ..... | 451/5 |
| 6,419,563 B1 * | 7/2002 | Ido et al. | ..... | 451/57 |
| 6,684,500 B1 * | 2/2004 | Kohlhase et al. | ..... | 29/888.08 |

FOREIGN PATENT DOCUMENTS

| | | | |
|---|---|---|---|
| EP | 0 807 489 A1 | 11/1997 | ..... B23Q/16/02 |
| GB | 674065 | 6/1952 | |
| JP | 52063996 | 2/1977 | |
| JP | 53001368 | 1/1978 | |
| JP | 09061190 | 3/1997 | |
| WO | WO95/05265 | 2/1995 | ..... B24B/5/42 |

* cited by examiner

*Primary Examiner*—Eileen P. Morgan
(74) *Attorney, Agent, or Firm*—Head, Johnson & Kachigian

(57) ABSTRACT

The invention concerns a method and an apparatus in which crankshafts and similar components can be machined at the relevant machining locations (big-end bearing locations, main bearing locations, side cheek side surfaces, end journal/end flange) on one machine and thus with a low level of expenditure in terms of investment items and nonetheless overall in highly time-efficient manner, by mechanical material removal in one and the same machine, wherein in all machining steps the workpiece is gripped on the central axis and is drivable in rotation and the concentric rotationally symmetrical surfaces are machined by workpiece-based methods.

24 Claims, 7 Drawing Sheets

MULTI-PURPOSE MACHINE

CROSS-REFERENCE TO RELATED APPLICATION

This is a United States National Phase Application of PCT application Ser. No. PCT/EP01/12247 entitled "Combination Machine" which has an International filing date of 23 Oct. 2001 and which claims priority to German Application No. 10052443.5 filed 23 Oct. 2000.

BACKGROUND OF THE INVENTION

The invention concerns the machining of workpieces by means of material-removing, preferably mechanically material-removing, methods and apparatuses in that respect, wherein the workpieces include rotationally symmetrical surfaces which are arranged both concentrically and also eccentrically with respect to the central axis of the workpiece, and possibly end faces extending beyond same, which are to be machined.

A typical workpiece of that kind is crankshafts in which the peripheral surfaces of the main bearings represent the concentric rotationally symmetrical surfaces and the peripheral surfaces of the big-end bearings represent the eccentric rotationally symmetrical surfaces. In addition machining operations on the end journals or end flanges (of small or large outside diameter respectively) which are admittedly concentric but which represent the end region and thus the region for gripping the workpiece in chucks represent a difficulty, and similarly for machining side cheek side surfaces, which involves the removal of large amounts of material.

Crankshafts are typical representatives of workpieces which combine the following problems:

rotationally symmetrical workpiece surfaces which are positioned both concentrically and also eccentrically have to be machined, in addition end faces have to be machined, also the end regions of the workpiece, at which the workpiece is normally clamped in the chucks of the machine, also have to be machined, and they must be in conformity with the other regions of the workpiece in terms of roundness and central alignment, to a high degree, and by virtue of its geometry the workpiece exhibits little resistance in relation to in particular radially applied machining forces.

The known range of material-removing machining methods is available for machining the individual surfaces, beginning with the chip-cutting machining methods whose tools have a geometrically defined cutting edge. Those methods can be divided into the following two groups:

workpiece-based methods, that is to say methods in which the desired cutting speed (relative speed between the surface of the workpiece and the cutting edge of the tool, which operates thereon) is achieved primarily by the rotational speed of the workpiece: longitudinal turning, face turning, broaching, rotational broaching (the broaching cutting edges are arranged on the periphery of a round main tool body which rotates in the machining operation, but more slowly than the workpiece), turning rotational broaching (supplemental to the above-described rotational broaching, the main tool body also carries turning tools, in use of which the rotational broaching tool does not rotate but is displaced linearly in the X-or Z-direction with respect to the workpiece for longitudinal turning or face turning), finishing (grinding with a substantially stationary finishing tool; even finer grain size than grinding tools), and tool-based methods in which therefore the cutting speed is produced primarily by the movement, in particular rotational movement, of the tool: orthogonal milling (a milling tool which is disposed with its axis of rotation perpendicular to the rotationally symmetrical surface to be machined machines that surface primarily with the end cutting edges on the face of the milling tool), external milling (a disk-shaped milling cutter whose axis of rotation is parallel to the axis of rotation of the workpiece primarily machines with the cutting edges arranged on its outside periphery, the corresponding peripheral surface of the workpiece), and external round grinding (instead of the above-described disk-shaped milling tool, a disk-shaped grinding disk is used in the same positioning with respect to the workpiece).

In that respect, the last-mentioned representatives in each of the two groups are already methods with a cutting edge which is geometrically not defined.

In addition there are also methods which remove material without a mechanically operable cutting edge, for example electro-erosion methods, material removal by means of laser and so forth, in which however only slight relative speeds between the tool and the workpiece are necessary and that relative speed can be afforded selectively by movement of the workpiece and/or movement of the tool.

For large-scale mass production of workpieces of that kind such as for example automobile crankshafts a machining time which is as short as possible—including set-up and dead times—for each crankshaft on the one hand and low tool and energy costs on the other hand are the crucial parameters, in dependence on the levels of surface quality (roundness, roughness depth and so forth) which can be achieved in that respect and which can govern the necessity for subsequent final machining steps such as grinding and/or finishing.

In that sense at the present time the machining methods which remove material by means of mechanical cutting are still to be preferred for large-scale mass production.

In that respect at the present time rotational broaching or turning-rotational broaching is in the forefront in regard to concentric rotationally symmetrical surfaces. At the present time external round milling is preferred in regard to the eccentric rotationally symmetrical surfaces, that is to say for example the big-end bearing locations. As the big-end bearing location rotates around the central axis of the workpiece during the machining procedure—so that it is possible to machine all peripheral points from one side—tracking of the corresponding tool, which is highly accurate in respect of time and geometry, is necessary at the same time. In order to be able to implement that, tool-based methods are preferred for machining those eccentric rotationally symmetrical surfaces. When using workpiece-based methods—in order to achieve a high cutting speed and thus efficient machining—the workpiece would rotate so fast that tracking adjustment of the tool would not be a viable option or the rotary speeds of the workpiece, which can be achieved in that way, and thus the cutting speeds, would not be competitive.

The methods which are preferred at the present time are generally used in succession on separate machines in large-scale mass production. In addition—mostly also on a separate machine or station in a production line—the end regions, in the case of a crankshaft therefore the end journals and the end flange, are firstly pre-machined separately at least at the periphery, optionally also at the end face, in order to afford defined clamping surfaces for the further machining procedure.

In accordance with the present application, in regard to the peripheral surfaces to be machined, reference is admittedly made only to rotationally symmetrical surfaces as that is by far the greatest proportion of machining situations involved. It will be appreciated that external round surfaces which are not rotationally symmetrical but convexly curved, such as for example the cams of camshafts, can also be similarly machined.

Occasionally consideration has also been given, for dealing with small numbers of items such as a pre-production design of crankshafts and so forth, for the machining of the concentric rotationally symmetrical surfaces to be effected by workpiece-based machining methods and for the machining of the eccentric rotationally symmetrical surfaces to be effected by tool-based machining methods on one machine, insofar as the two appropriate tool units are both present there. In that respect the extremely different rotary speed ranges to be implemented for the workpiece drive represented the one major problem and machining of the end regions of the crankshaft represented the other major problem.

SUMMARY OF THE INVENTION

Therefore the object of the present invention is to provide a method and an apparatus with which crankshafts and similar components can be machined at the relevant machining locations (big-end bearing locations, main bearing locations, side cheek side surfaces, end journal/end flange) on one machine and thus with a low level of expenditure in terms of investment items and nonetheless overall in a highly time-efficient manner.

b) Attainment of the Object

That object is attained by the features of claims 1 and 13. Advantageous embodiments are set forth in the appendant claims.

In this respect in all machining steps the workpiece is to be respectively clamped on the central axis and driven in rotation about that axis in order to avoid the use of mechanically highly involved and costly so-called cycle chucks which additionally severely limit the flexibility of a machine as they have to be matched to the dimensions of the crankshaft to be machined.

The use of workpiece-based methods for the concentric surfaces already affords in that situation a very short machining time, with at the same time very good surface quality.

Using the tool-based machining methods in relation to eccentric surfaces means that the speed of rotation of the workpiece can be kept so low that optimum tracking adjustment of the tool and thus optimum accuracy to size of those surfaces is still ensured.

In order to be able to achieve the possible maximum cutting speeds in the workpiece-based methods on the one hand and tool-based methods on the other hand, the workpiece which is supported in its end regions in spindles and which is drivable in rotation by means of chucks is selectively driven from both sides by way of different drives, wherein the one drive provides the highest possible rotary speeds for the workpiece-based machining methods which on the other hand require only low levels of torque, while the other drive admittedly only has to produce the low necessary workpiece speeds for tool-based machining methods, but with a high level of torque and while maintaining a defined rotational position for the workpiece, and thus also affording a positioning option in terms of the rotational position of the workpiece with respect to that spindle. Accordingly that slow drive is preferably provided with a self-locking action, embodied by means for example of a worm/worm wheel transmission. Both drives can be driven from separate motors (preferred) or from a common motor, but at least the self-locking slow drive train should be disconnectible, for example between the spindle and the self-locking location, or between the chuck and the spindle.

In order additionally to be able to machine end journals and an end flange, at least at the peripheral surfaces thereof, the spindles, besides a conventional clamping chuck, for example a three-jaw chuck, must also have a centering point, wherein the centering point and the jaws of the jaw chuck are displaceable relative to each other in the axial direction (the Z-direction), for example by using chucks with retractable clamping jaws. In that way, it is possible for a respective end region to be non-rotatably connected to the respective spindle by means of a chuck clamping action, while the other end region which is to be machined at the time is only supported by a centering point.

In that case the end region accommodated in the slow spindle can be driven at high speeds of rotation—by virtue of the drive by the fast spindle—and thus can be machined with the workpiece-based machining method also used for the central bearings, for example turning-rotational broaching.

Limitations in respect of efficiency are necessary only in the converse situation, that is to say when machining the end region which is accommodated in the fast spindle, generally being the end flange: in the machining procedure it is only held by a centering point while the workpiece is driven in rotation at the opposite side by the jaw chuck of the slow spindle.

Realistically there are only two possible ways of carrying out the machining procedure, by virtue of the slow speed of rotation of the workpiece:

Either machining by means of one of the workpiece-based methods, but, because of the low speed of rotation of the workpiece, at a very low cutting speed, with a corresponding limitation to cutting materials which are suitable for that purpose. In regard to turning, that is for example high speed steel (HSS).

As the other surfaces, for example the central bearings, which are machined by means of tool-based methods, even when using the turning procedure, have to be machined with tools comprising hard metal, cutting ceramic and similar high-efficiency materials, such HSS-cutting edges HSS-cutting edges additionally have to be provided on the corresponding main tool body, just because of that end flange machining procedure.

Cutting edges of hard metal or carbide metal or cutting ceramic would be damaged too quickly, at those low speeds of rotation of the workpiece.

The other possibility involves machining that end region in a similar manner to the low speed of workpiece rotation with tool-based methods, that is to say for example by means of external round milling. A disadvantage in this respect is the level of surface quality which can be achieved, that is slightly worse than in comparison with workpiece-based methods. As generally identical minimum requirements in regard to surface quality are made for all similar workpiece surfaces, for example all central bearing locations, this end flange machining operation under some circumstances does not achieve a quality aspect which can be achieved for all other central bearing locations, by virtue of the more appropriate machining method.

As, when machining at least one of the end regions (end journal/end flange), clamping of the workpiece by means of chucks is generally firstly necessary at the non-machined external periphery of the workpiece, at least that appropriate chuck must have compensating clamping jaws. Likewise it is necessary to provide at one of the spindles a means for fixing the rotational position of the workpiece with respect to one of the spindles, for example a stop for defining a rotational position or aligning jaws in the corresponding jaw-type chuck.

Since, as described above, methods and machines of this kind serve primarily for producing crankshafts or similar workpieces in small numbers, frequently only in the form of individual items, the external round milling cutters are selected to be relatively narrow so that they can be used for all crankshafts to be produced. Then however—after machining of a first axial region on a big-end bearing by means of external round milling cutters axial displacement of the milling cutter—whether continuous or stepwise is appropriately necessary until the entire bearing width has been machined.

For that purpose on the one hand the milling cutter must be displaceable in the Z-direction, that is to say the tool support must have a Z-carriage, and on the other hand the cutting edges of the milling cutter must be provided not only on the outside periphery thereof but also in the outer edge region of the end face in order also to be able to cut at the end face, with a continuous feed in the Z-direction. Otherwise the only possible form of cutting is machining in an axially portion-wise manner by means of plunge-cutting and peripheral machining.

If it is exclusively the machining of individual items that is intended or if the machining time plays only a highly subordinate part, it is possible to deviate from the above-described idea for attaining the object of the invention, in that the eccentric rotationally symmetrical surfaces are machined with a workpiece-based machining method such as for example turning, in spite of the drive afforded during machining thereof, by way of the slow spindle drive. As described hereinbefore in regard to machining of the end region which is accommodated in the fast spindle chuck but which can be only slowly driven, that overall very greatly increases the machining time for the big-end bearings and thus the crankshaft and in addition cutting materials which are suitable for that low cutting speed such as for example HSS-cutting edges must be used.

The advantage of such a procedure however, viewed from the mechanical engineering point of view, is that the same machining method is used for big-end and main bearings, even if at greatly different cutting speeds, and consequently with the necessity for different cutting materials. Those cutting edges which consist of different material can either consist, as described above, of two separate tool units, more specifically for example cutting edges of ceramic cutting materials on a main tool body and HSS-cutting edges on the other main tool body. Both tool systems however require the same possible movements (besides displacement in the X- and Z-direction, either a pivotal movement about the C2-axis or displacement in the Y-direction) and consequently can be of an identical structure and can be equipped with an identical control system, which reduces costs.

When considered one step further—as the workpiece-based methods exclusively involve machining methods in which the tool does not necessarily have to rotate through a full 360°—cutting edges of both kinds of cutting material can be arranged at the same time on the same, for example disk-shaped, main tool body, so that overall only one single tool unit would be necessary on the machine.

The above-mentioned high and low speeds of workpiece rotation and cutting speeds or torques, in regard to the drive for the workpiece, are intended to denote approximately the following ranges of values:

High speeds of workpiece rotation of between 40 rpm and 1600 rpm, in particular between 200 rpm and 800 rpm, low speeds of workpiece rotation of between 0 rpm and 40 rpm, in particular between 20 rpm and 40 rpm, high torques of the workpiece drive of between 600 Nm and 3,000 Nm, in particular between 2,000 Nm and 2,500 Nm, low levels of torque of the workpiece drive of between 200 Nm and 600 Nm, in particular between 300 Nm and 550 Nm, and cutting speeds of between 150 m/s and 700 m/s, in particular between 180 m/s and 250 m/s.

A detail problem represents the undercuts which are frequently required in relation to crankshaft bearing locations at the edge of the bearing location, which are easy to produce by means of turning in relation to central bearing locations, but which cannot be produced when machining the big-end bearings by means of a tool-based method. For that case, after machining of the peripheral surface of such a big-end bearing, the corresponding undercuts have to be produced by means of turning. As in that case the big-end bearing location rotates eccentrically about the central axis of the workpiece, that rotary cutting edge must perform a tracking action as the workpiece rotates and by virtue thereof the workpiece can only be driven at the low speed of rotation. Accordingly here too cutting means of suitable cutting materials such as for example HSS are required.

BRIEF DESCRIPTION OF THE DRAWINGS

An embodiment according to the invention is described in greater detail by way of example hereinafter. In the drawing.

BRIEF DESCRIPTION OF THE PREFERRED EMBODIMENTS

Figure 1A:
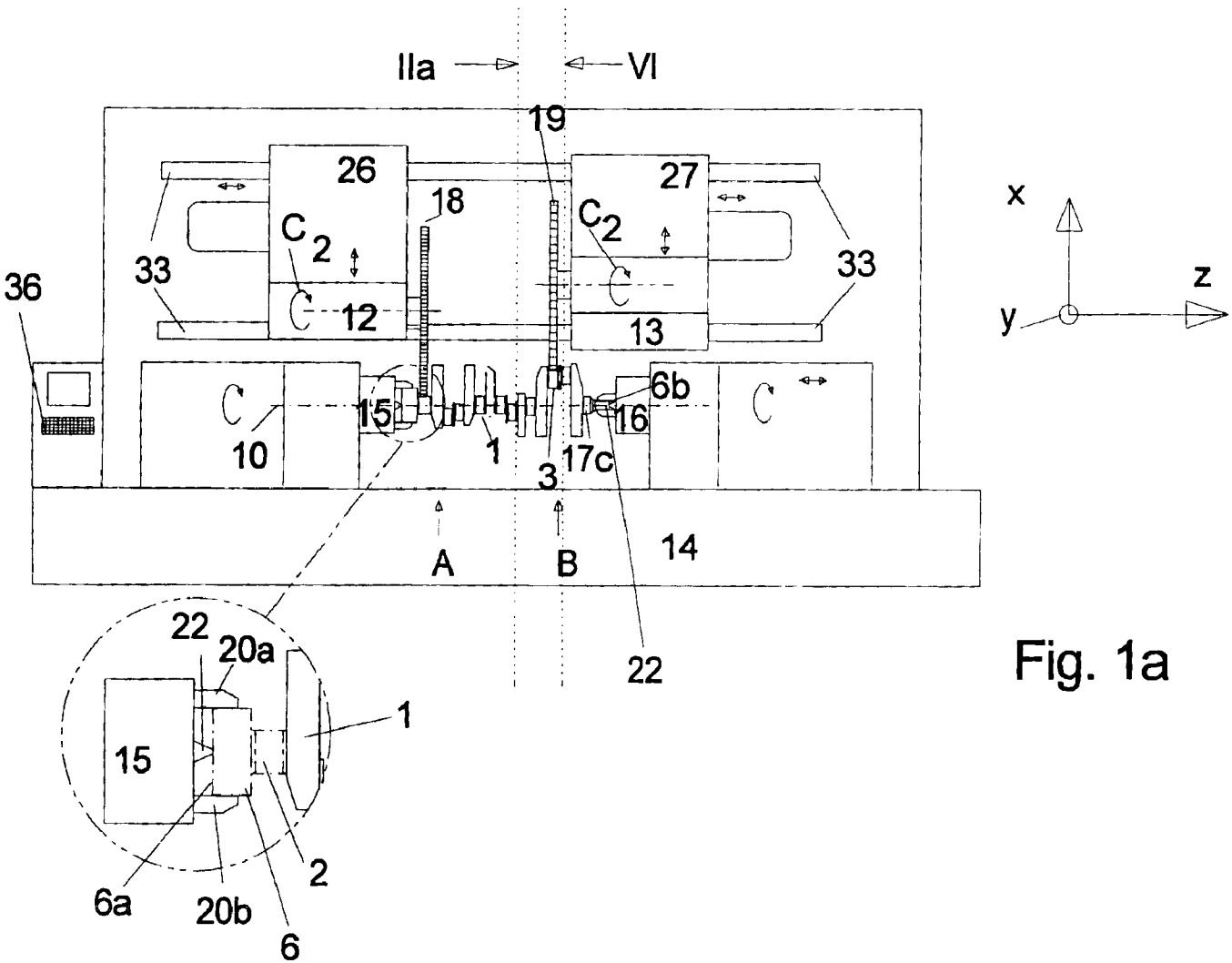
FIG. 1*a* shows a front view of a machine according to the invention.

FIG. 1*a* shows a machine tool which accommodates drivably in rotation at its end region and machines a workpiece, for example the illustrated crankshaft 1 which includes both concentric surfaces 2, for example main bearing locations, and also eccentric surfaces 3, for example big-end bearing locations.

In this case the axial end regions of the workpiece are received in the receiving devices of two oppositely directed, mutually aligned spindles 15, 16. The receiving devices used are both jaw chucks 20 and 21 respectively and also centering points 22, 23 which are arranged at each of the spindles 15, 16.

The spindles 15, 16 are arranged on the bed 14 of the machine, like the tool supports 12, 13 which each carry a respective tool unit which is drivable in rotation about an axis (C2-axis) which is parallel to the axis of rotation (Z-axis) of the workpiece.

In addition the tool supports 12, 13 are displaceable in a defined fashion in the X-direction, that is to say transversely with respect to the axial Z-direction, on the respective Z-carriages 26, 27 which are displaceable in the Z-direction. The Z-carriages are displaceable along the Z-guides 33. The tool units are generally disk-shaped main tool bodies, wherein the main tool body 18 of the one tool support 20 is occupied in the outer peripheral edge by cutting edges which can be used for a workpiece-based method, for example with turning cutting or turning-rotational broaching cutting.

Accordingly that main tool body 18 does not necessarily have to be rotated definedly over a full 360°, but pivotal movement through smaller angular ranges around the C2-axis is already sufficient. It is however necessary for the main tool body 18 to occupy a defined rotational position. Accordingly that main tool body 18 is illustrated when machining a concentric rotationally symmetrical surface 2, namely a central bearing.

In contrast thereto, the other main tool body 19 is provided with cutting edges for a tool-based method, for example with milling cutting edges, at its outer peripheral region, which accordingly are distributed preferably over the entire periphery of the disk-shaped main body 19, in particular being distributed uniformly. The main tool body 19 of that tool-based method must accordingly be drivable in rotation over more than 360°, in particular over any number of revolutions.

The Z-guides 33 are of such a length that both main tool bodies 18, 19 can reach any axial position on the workpiece in the Z-direction, in particular also the end regions, more specifically the end journal 5 shown at the right-hand end of the crankshaft in FIG. 1*a* and the end flange 6 shown at the left-hand end of the crankshaft 1 which is of a larger outside diameter than the end journal 5.

As in particular the detail view of the left-hand receiving region in FIG. 1*a* on an enlarged scale shows, the crankshaft is held and driven in rotation during the machining operation preferably at both ends in the respective jaw chucks 20, 21, that is to say by means of radially gripping clamping jaws 20*a*, 20*b*, . . . , 21*a*, 21*b* . . . .

It is only if the peripheral regions necessary for application of the clamping jaws and the end faces of the crankshaft are being machined that the clamping action applied by means of clamping jaws is released at the respective end, and the crankshaft is held at that end exclusively by means of a centering point 22, 23, engaging in a corresponding centering bore in the crankshaft. At the same time the clamping jaws at that end are axially withdrawn in the Z-direction with respect to the centering point so that the tool in question can act on the end face, for example 5*a*, or the peripheral surface of the end flange or end journal.

In that respect preferably the entire spindle stock in which one of the spindles, for example the spindle 16, is mounted, is definedly displaceable in the Z-direction with respect to the bed 14 of the machine. That makes it possible to machine workpieces of different lengths, and also makes it easier to load and unload the machine with workpieces. Whether, in the axial relative movement of the jaws of a jaw-type chuck with respect to the centering point arranged on the same spindle in the Z-direction, the jaws are movable with respect to the jaw-type chuck or the centering point is movable relative to the clamping chuck or the spindle, is not critical, in which respect in a practical context displacement of the centering point 22, 23 in the Z-direction with respect to the associated jaw chuck and the associated spindle is preferred, as is shown by way of example in FIGS. 3*a* and 3*b* separately for the left-hand and the right-hand sides of the machine. It is further immaterial whether, when the workpiece is clamped in the jaw-type chuck on the same side, the clamping action by the centering point is additionally maintained at the same side.

Figure 1B:
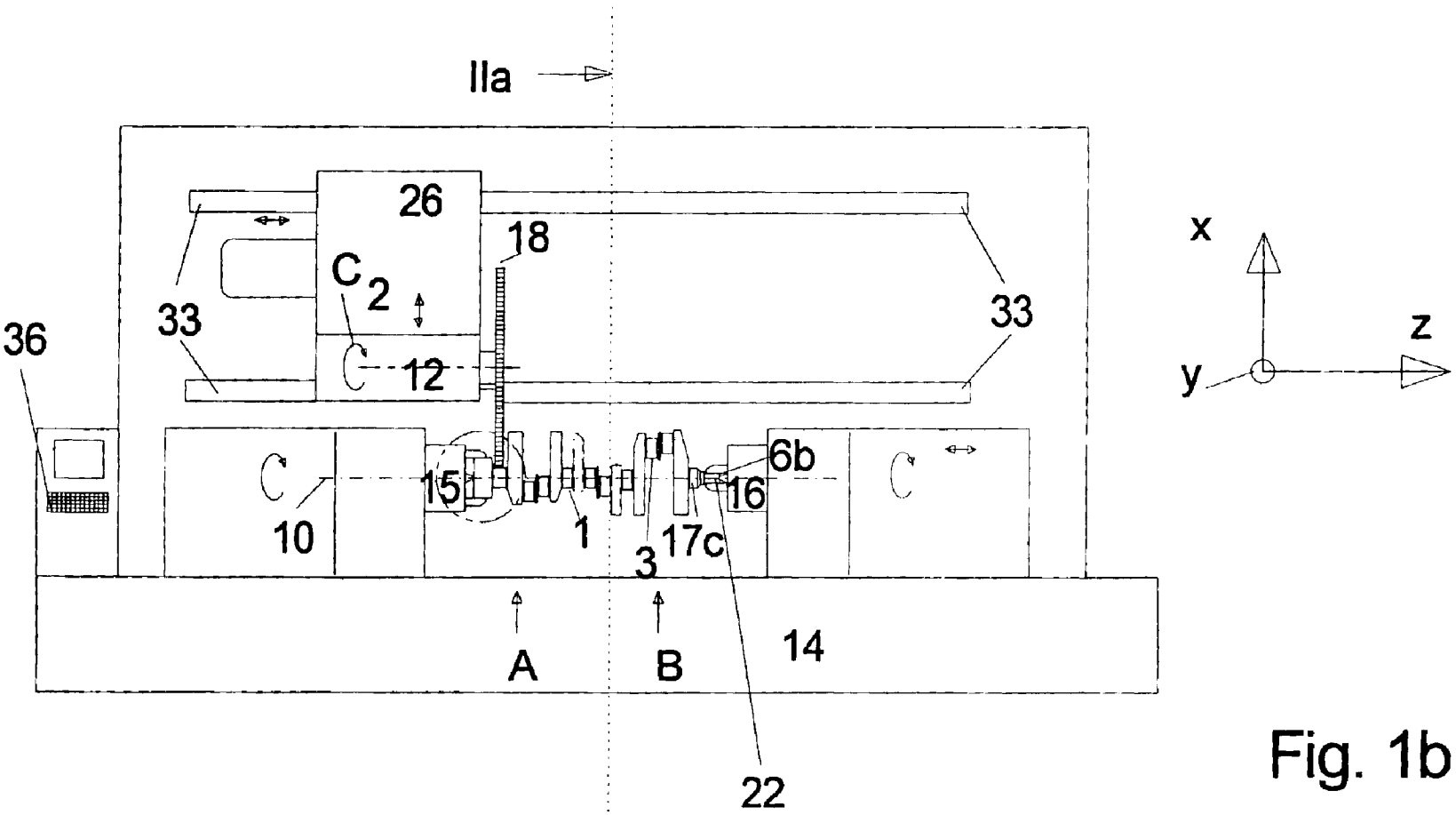
FIG. 1*b* shows a front view of another machine according to the invention.

FIG. 1*b* shows a machine tool which differs from the structure shown in FIG. 1*a* in that the tool support 13 with the associated main tool body 19 which carries the cutting edges for the tool-based method or methods is omitted.

Figure 2B:
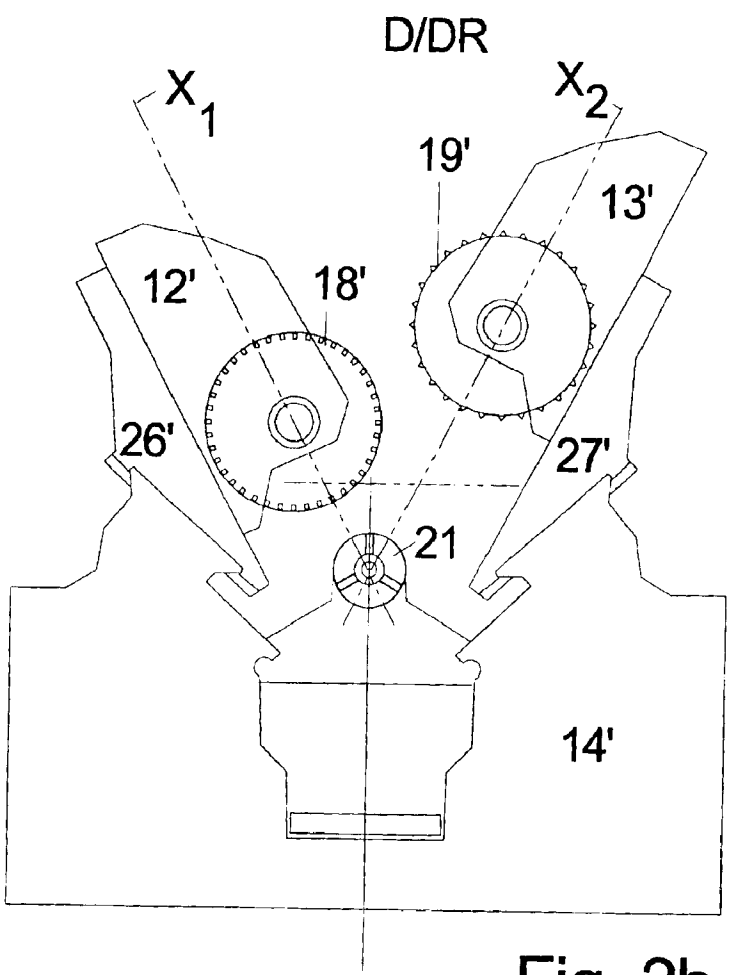
FIG. 2*b* shows a side view of another configuration of the machine.
Figure 2A:
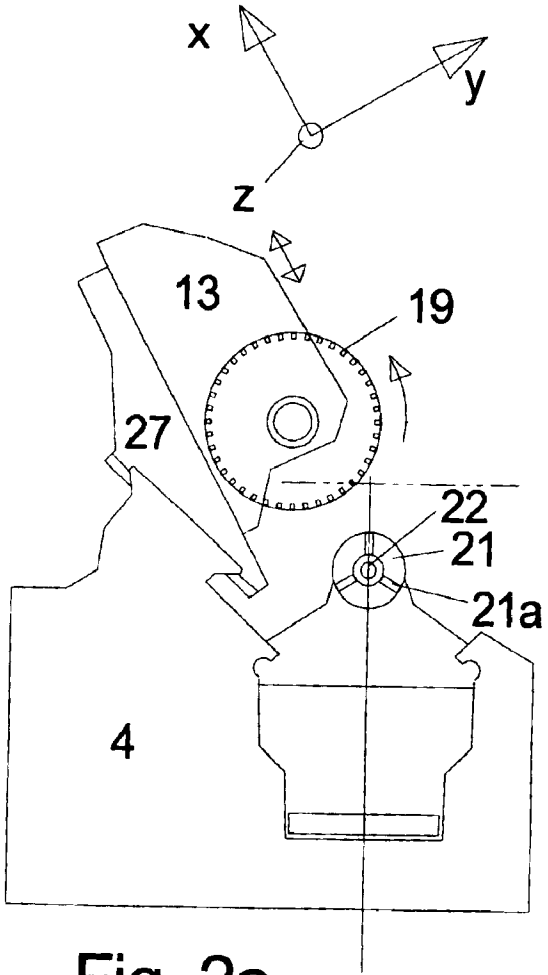
FIG. 2*a* shows a side view from the left of the machine of FIG. 1*a,*

FIG. 2*a* shows the machine of FIG. 1*a* from the left-hand side in section taken along line IIa—IIa. It can be seen in this respect that the spindle stock carrying the spindle 16 is disposed displaceably in the Z-direction over the trough configuration of a trough-shaped bed 14. The tool support 13 which carries the main tool body 19 drivably in rotation and which is in the form of an X-carriage is in turn guided on a Z-carriage displaceably in the X-direction, wherein the X-direction in this case is inclined directed obliquely downwardly at an angle of between 60 and 80° with respect to the horizontal.

The guide plane of the Z-carriage 27 with respect to the bed 14 is also not horizontal or vertical, but inclined at an angle of between about 40 and 50° with respect to the horizontal.

FIG. 2*b* in contrast shows a bed construction with a bed 14' which is of a symmetrical configuration with respect to the Z-direction, that is to say on two mutually oppositely and inclinedly arranged guide surfaces it carries a respective Z-carriage 26', 27' which each in turn carry a tool support 12', 13' with corresponding main tool bodies 18', 19', the tool supports being displaceable in the X1-direction and the X2-direction respectively which diverge upwardly in a V-shape.

Figure 3A:
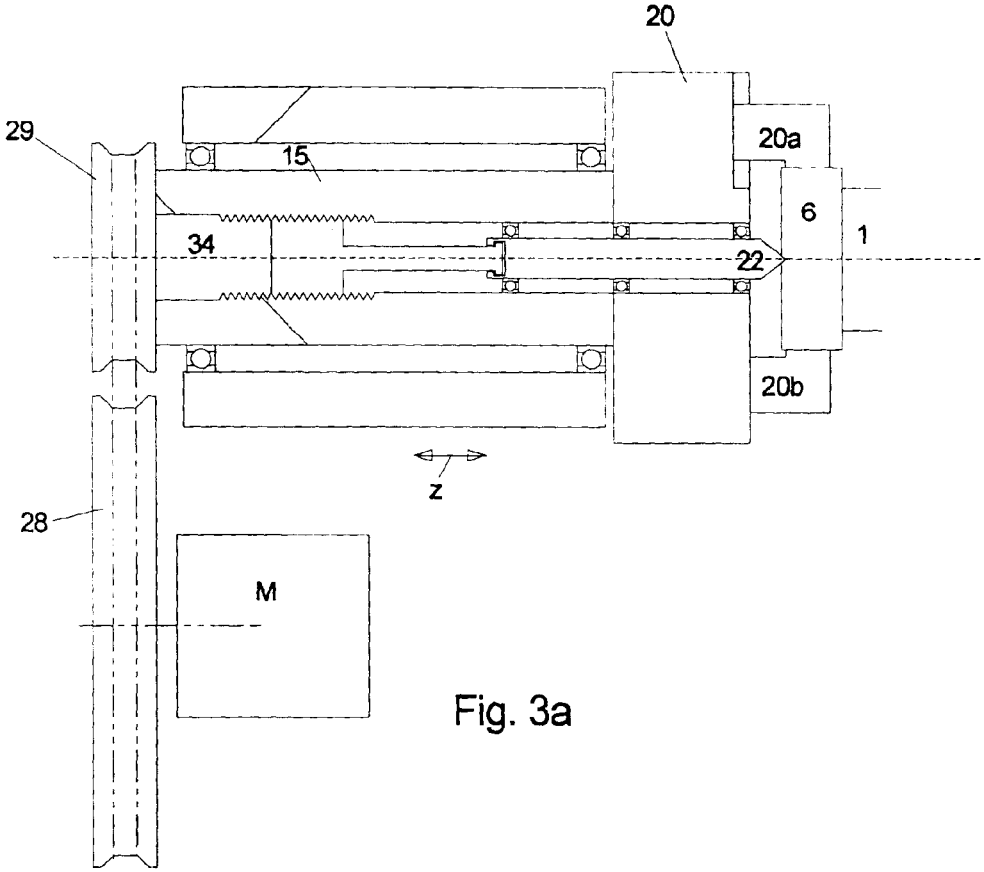
FIG. 3*a* shows a partial section on an enlarged scale of the left-hand spindle region of the machine shown in FIG. 1*a,*
Figure 3B:
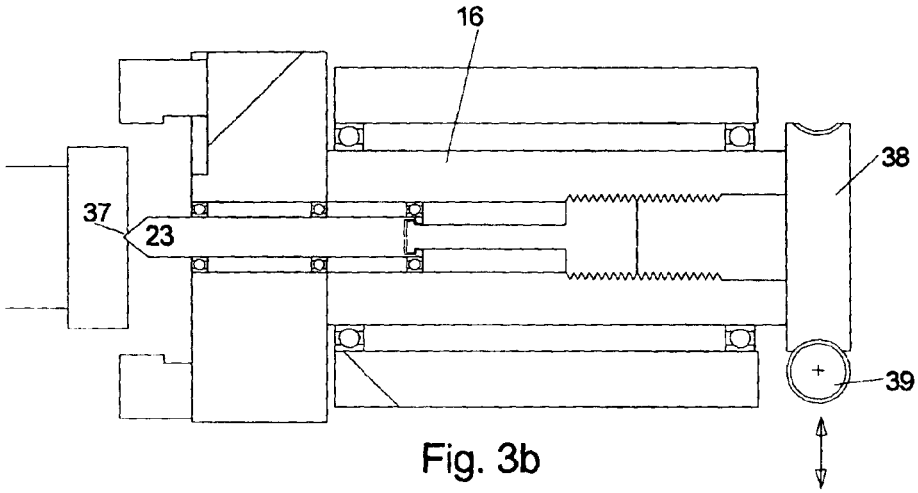
FIG. 3*b* shows a partial section on an enlarged scale of the right-hand spindle region of the machine shown in FIG. 1*a,*

FIGS. 3*a* and 3*b* show the left-hand and right-hand spindle stocks of the machine.

In this case the respective spindle 15 or 16 respectively is rotatably mounted and axially fixedly positioned in the spindle stock which is not identified in greater detail here. The jaw chuck 20 and 21 respectively with the clamping jaws 20*a*, . . . , 21*a*, . . . is carried on the front end of the spindle connected non-rotatably to the latter.

Both the spindle 15 and 16 respectively and also the jaw chuck 20 and 21 respectively are of a hollow configuration therethrough in the center in the Z-direction and supported in that hollow space is the centering point 22 and 23 respectively which can also be positioned to project forwardly out of the jaw chuck 20 and 21 respectively.

The centering point is mounted rotatably with respect to the spindle and the jaw-type chuck and displaceably in respect of axial position.

As will also be described with reference to FIGS. 4 and 5 for the machining operation, under some circumstances, it is necessary to be able to fix the Z-position of the centering pint 22, 23, in spite of free rotatability about the Z-axis. In the structures shown in FIGS. 3*a* and 3*b*, that is achieved by means of a centering abutment 34 and 35 respectively which is displaceable in the interior of the spindle 15 in the Z-direction and which in particular can be screwed with respect to the inside diameter of the spindle 15 by means of a screwthread and which is connected by way of an undercut configuration to the rear end of the centering point 22, 23 and which can thus both push and also pull the centering point. In that case the arrangement must afford relative rotatability between the centering point 22, 23 and the centering abutment 34, 35.

FIG. 3*a*—like FIG. 1—shows the workpiece, namely the crankshaft 1, with the end flange 6 at the left-hand end and the end journal 5 at the right-hand.

In this case the crankshaft 1 is held on the left-hand side insofar as there the clamping jaws 20*a*, 20*b*, . . . of the jaw chuck 20 bear against the outside periphery of the end flange 6 and clamp same, the centering point 22 additionally engaging into the corresponding centering bore 36. On the right-hand side in contrast the crankshaft is held exclusively by means of the centering point 23 which engages into the centering bore 37 and which accordingly projects further with respect to the associated jaws 21*a*, 21*b*, . . . of the jaw chuck 21.

In this case also the Z-position of the centering point 23—similarly to the other centering point 22—is fixed by means of a fixing abutment 35 fixable in the axial position, insofar as for example the screwthread between the centering abutment 34/35 and the surrounding spindle 15, 16 is of a self-locking nature.

The two spindle sides also fundamentally differ in regard to the alternate drives:

The one spindle 15, for example the left-hand spindle, is drivable at high speeds of rotation by means of a motor M which is mounted to the spindle stock and drives the spindle 15 in rotation about the Z-axis for example by way of a belt drive and associated belt pulleys 28, 29.

The other spindle 16, for example the right-hand spindle, is in contrast drivable in rotation slowly by means of a further motor (not shown) by way of a set of gears, insofar as the worm gear 38 is nonrotatably connected to the spindle 16 while the motor (not shown) drives the worm 39. That drive train can be disconnected, for example by bringing the worm 39 and the worm wheel 38 out of engagement, or by means of disconnection of a clutch (not shown) in that drive train.

FIGS. 4 and 5 show typical clamping situations for the workpiece, for example a crankshaft 1, when machining the different regions of the workpiece.

As the machine/method according to the invention is not designed for the highest possible level of machining efficiency but for complete machining of concentric and eccentric surfaces and end faces on the same machine, then for example when dealing with crankshafts preferably the end regions of the crankshaft are also to be machined in order very substantially to avoid preliminary machining—except for producing centering bores for the centering tips. In that case the peripheral surfaces of the end flange 6 and the end journals 5 which are to be engaged by the clamping jaws of the jaw chuck are preferably machined first and—if necessary and desired—also the respective end faces 5*a* and 6*a* are machined.

When machining the end regions of a workpiece the end region to be machined is preferably held exclusively by means of a centering point while the drive is effected from the other end of the workpiece by way of the spindle there, in order to permit accessibility for the corresponding tool in the end region.

FIGS. 4*a*–4*d* show situations in which the crankshaft is clamped and driven in rotation at the left-hand end by means of the jaws 20*a*, 20*b*, . . . of the chuck 20, at the periphery of the left-hand end region, that is to say for example the end flange 6 there. In the arrangement shown in FIG. 3*a*, 3*b* that is the spindle 15 which is drivable fast.

In this respect the other right-hand end of the workpiece must be freely rotatable as, by means of the slow rotary drive at the right-hand end for the right-hand spindle 16, synchronous drive at an also high rotary speed is not possible.

That is achieved in that—as shown in FIGS. 4*a*–4*d*—the right-hand end of the workpiece is held by only the right centering point 23 fitting in the corresponding right-hand centering bore 37 in the workpiece, and the right centering spindle 23 being freely rotatable with respect to the right workpiece spindle 16 and the right drive train.

Figure 4A:
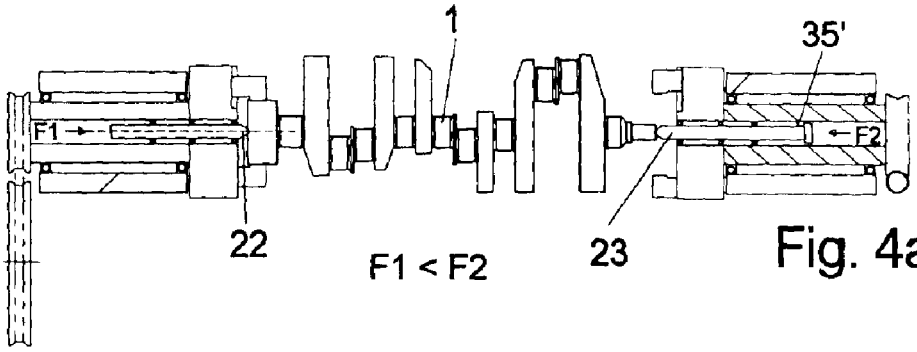
FIG. 4 show views illustrating the principle involved with a left-side drive for the workpiece, FIG. 5 show views illustrating the principle involved with a right-side drive for the workpiece.
Figure 4B:
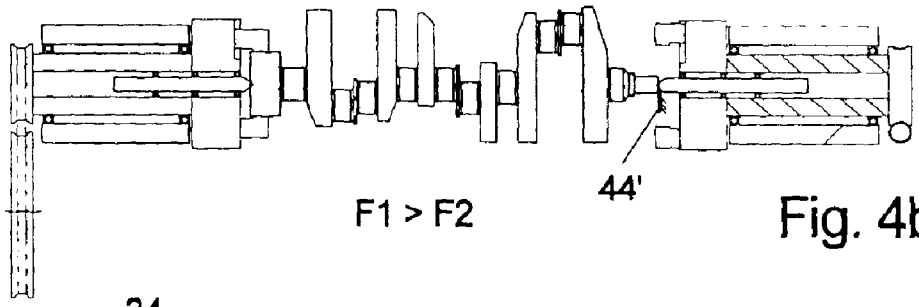
Figure 4C:
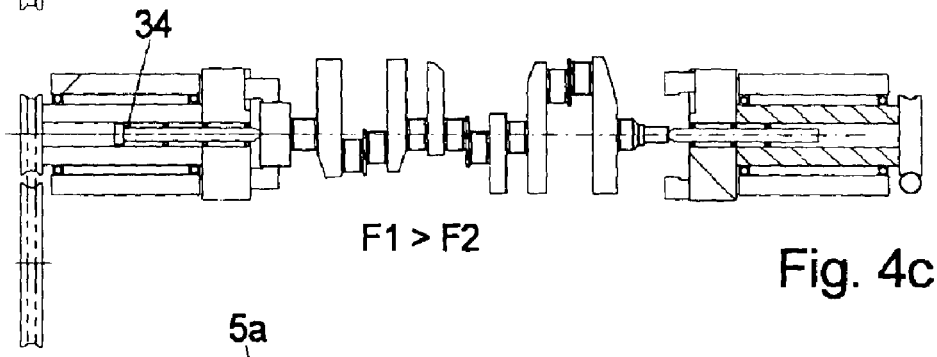
Figure 4D:
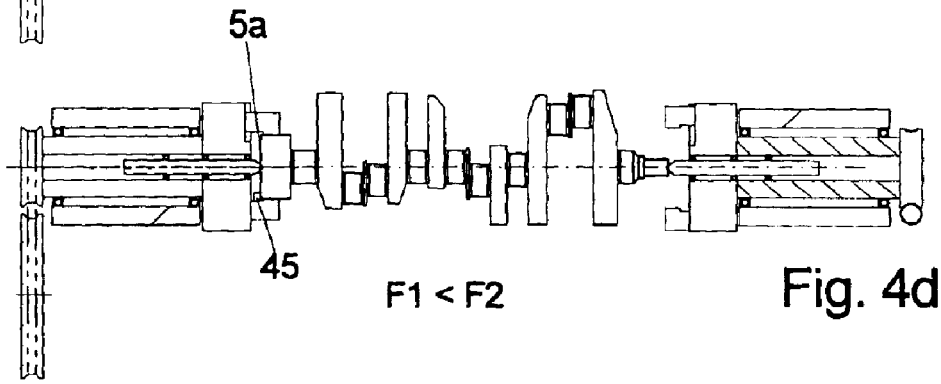
Figure 4E:
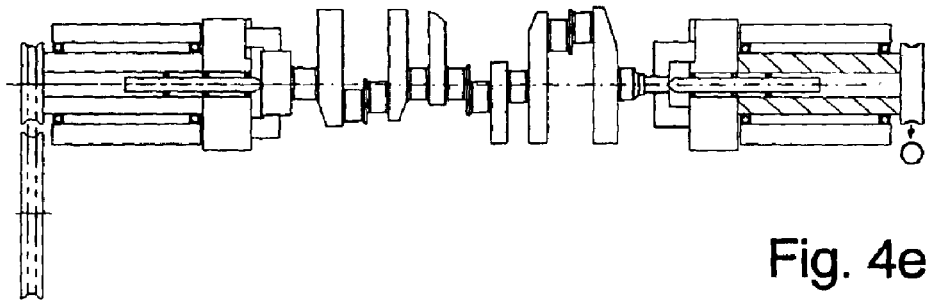

The other possibility involves admittedly clamping the right-hand end of the crankshaft, that is to say the end towards the slow spindle drive, in the jaw-type chuck there, but uncoupling the drive train of the right-hand chuck, for example by disengagement of the worm 39 from the worm gear 38 of the drive train, as shown in FIG. 4*e*.

By virtue of the clamping configurations as shown in FIG. 4 the workpiece can be driven at a high speed of rotation and thus all concentric machining surfaces can be machined on the workpiece by means of a workpiece-based machining method such as for example turning, rotational broaching or turning-rotational broaching. That also involves the end journal 5 arranged on the right-hand side and the end face 5*a* thereof which can be machined to close to the right-hand centering point 23 which is in engagement.

In that situation the workpiece also has to be disposed in a defined Z-position.

As shown in FIG. 4*a*, for that purpose the right-hand centering tip together with the workpiece can be displaced towards the left until the right-hand centering point 23 reaches a centering abutment 35', for example in the form of the centering abutment 35 shown in FIG. 3. In that case the force F2 which acts from right to left and to which the right-hand centering point 23 is subjected must be greater than the oppositely directed force F1 to which the left-hand centering point 22 is subjected.

The same also applies in the case shown in FIG. 4*d*, but therein, in the region of the left-hand chuck, there is a workpiece abutment 45' by which the workpiece is pressed with the left-hand end face 6*a* against that workpiece abutment 45'.

If in contrast the force F1 to which the left-hand centering point 22 is subjected is greater than the force acting from right to left of the right-hand centering point 23, then as shown in FIG. 4*b* there must be a workpiece abutment 44' at the right-hand side in the region of the right-hand spindle 16. In that case at the same time the right-hand centering point 23 must remain axially fixed in the right-hand centering bore 37 of the workpiece, that is to say it must be possible to fix the Z-position of the right-hand centering point 23 without impeding rotatability of the centering point.

FIG. 4*c* differs from the structure shown in FIG. 4*b* in that—with the same relationship of left to right force in respect of the two centering points—the left-hand centering point which is subjected to the higher force is pressed against a long-side centering abutment 34'. As in the case of the structure shown in FIG. 4*b*-that too must happen before the jaws 20*a*, 10*b* of the left-hand jaw chuck 20 are closed.

FIG. 5 in contrast shows the drive for the crankshaft from the right-hand side, that is to say by way of the slow drive train. Therefore in FIG. 5 the right-hand end, for example the end journal 5, of the crankshaft 1 is gripped at the periphery by the jaws 21*a*, 21*b* of the right-hand chuck 21 which is drivable in rotation slowly by the associated spindle 16.

Figure 5A:
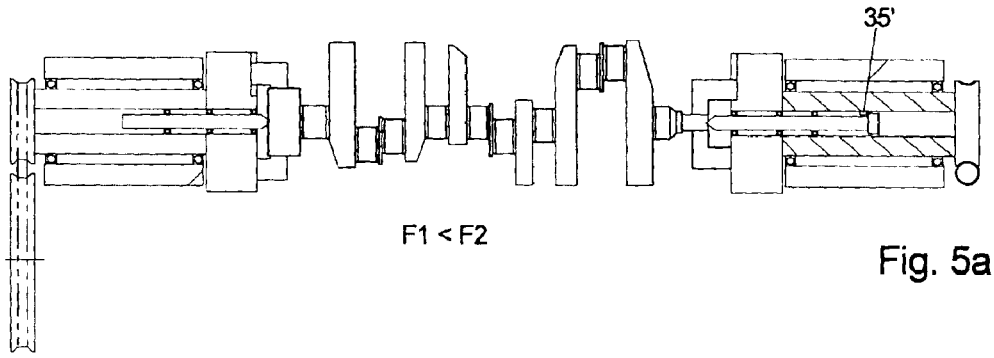
Figure 5B:
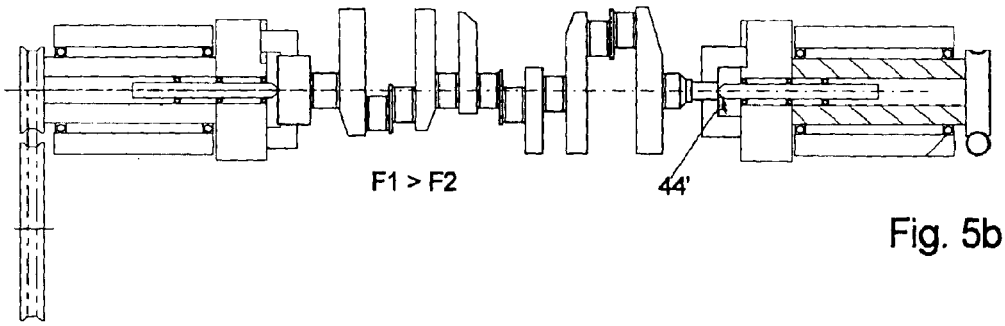

With this kind of drive the eccentric surfaces, peripheral surfaces as well as end faces of the workpiece are machined by means of a tool-based method, in which case the tool must be caused to perform tracking adjustment in the X-direction, as described with reference to FIG. 6. In that respect the opposite left-hand end of the workpiece—as shown in FIGS. 5*a* and 5*b*—is also accommodated between the jaws 20*a*, 20*b*, of the chuck 20 there, as the drive train on the left-hand side is not self-locking and is also driven in an idle rotational mode from the right-hand drive train, by way of the workpiece. That does not in any way result in unwanted twisting of the workpiece, but rather the idly rotating drive train at the left-hand side, which is connected to the workpiece, serves for dynamic damping of the workpiece during the machining operation. This is advantageous as the tool-based methods which are used here such as for example milling, because of the interrupted cutting action, involve a greater dynamic loading on the workpiece than the tool-based methods.

In addition the left-hand centering point 22 can remain in engagement on the workpiece, on the left-hand side.

It is also possible for the left-hand side of the workpiece to be carried exclusively by means of the left-hand centering point 22.

In order in this case also to hold the workpiece in a defined Z-position, either (FIG. 5*a*) the right-hand centering tip 23 can be moved against a centering abutment 35' at the right-hand side, in which case then—similarly to FIG. 4*a*—the force F2 acting from right to left on the workpiece by means of the right-hand centering point must be greater than the oppositely acting force F1 of the left-hand centering point or left-hand chuck.

The other possibility, as shown in FIG. 5*b*, involves making the force F1 acting from left to right on the crankshaft in the Z-direction by means of the left-hand centering point 22 or the left-hand chuck 20 greater than the oppositely directed force F2 and thereby pressing the workpiece against a workpiece abutment 44' at the right-hand side.

Figure 5C:
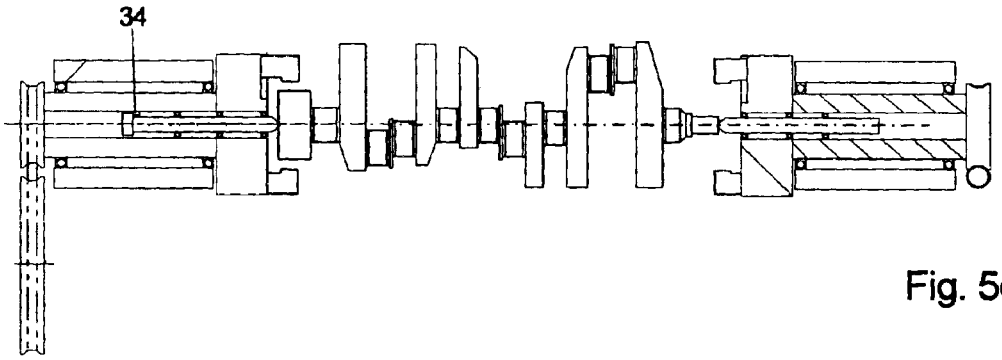

In that case—as shown in FIG. 5*c*—the workpiece can also be held at the left only by the centering point so that the jaws of the chuck are there lifted away from the workpiece.

Figure 6:
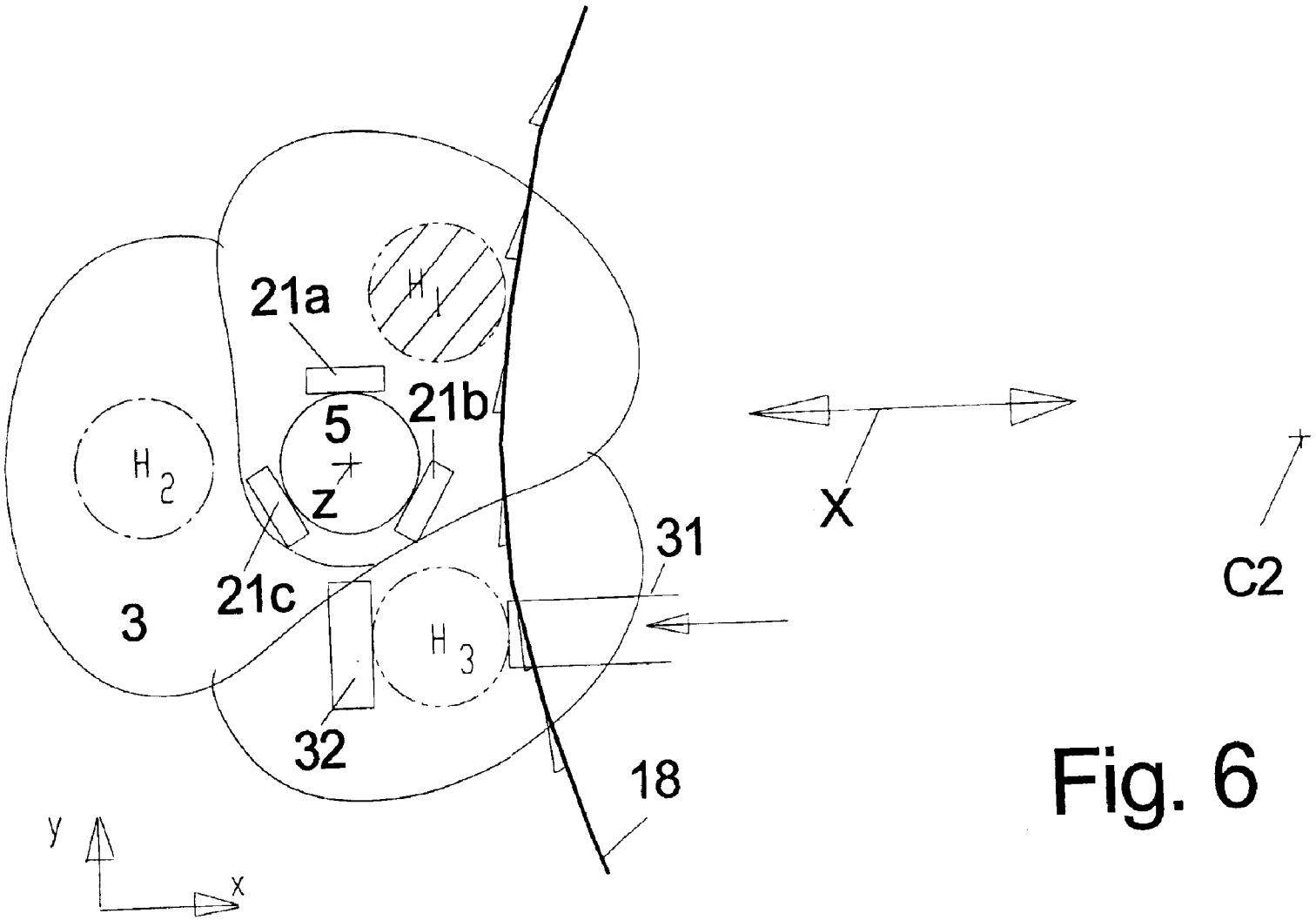
FIG. 6 is a view in section taken along line VI—VI in FIG. 1.

FIG. 6 shows the operation of machining a big-end bearing H1 of the crankshaft which is clamped and driven in rotation on the center bearing ML. It can be seen therefrom that, upon rotation of the crankshaft about the Z-direction, displacement of the big-end bearing journal H1 to be machined, in the X-direction, must be compensated by suitable tracking adjustment of the machining tool, for example the rotating main tool body 18, to the same amount in a similar direction. It will further be clear therefrom that the diameter of the main tool bodies must be selected to be sufficiently large that, at the furthest remote position of such an eccentric workpiece surface from the axis of rotation C2 of the main tool body, a machining operation is still to be guaranteed.

FIG. 6 also shows the end journal 5 accommodated between the jaws 21*a*, 21*b*, 21*c* of the chuck 21, as well as fixing of the rotational position of the crankshaft with respect to the chuck, by a push rod 31 pressing eccentrically and transversely with respect to the Z-direction against one of the other big-end bearing journals, for example H3, in order to press it against a rotational position abutment 32, in which respect the abutment 32 and the push rod 31 are non-rotatably connected to the chuck and the spindle respectively.

While the invention has been described with a certain degree of particularly, it is manifest that many changes may be made in the details of construction and the arrangement o components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

LIST OF REFERENCES

| | |
|---|---|
| 1 | crankshaft |
| 2 | concentric surface |
| 3 | eccentric surface |
| 4 | side cheek surface |
| 5 | end journal |
| 5a | end face |
| 6 | end flange |
| 6a | end face |
| 7 | big-end bearing |
| 8 | main bearing |
| 10 | Z-direction (axial direction) |
| 11 | machine |
| 12 | tool support |
| 13 | tool support |
| 14 | bed |
| 15 | spindles |
| 16 | spindles |
| 17 | motor |
| 18 | main tool body |
| 19 | main tool body |
| 20 | jaw-type chuck |
| 20a, 20b | jaw |
| 21 | jaw |
| 22 | centering point |
| 23 | centering point |
| 24 | longitudinal abutment |
| 25 | longitudinal abutment |
| 26 | Z-carriage |
| 27 | Z-carriage |
| 28 | belt pulley |
| 29 | belt pulley |
| 30 | end portion |
| 31 | push rod |
| 32 | rotational position abutment |
| 33 | Z-guides |
| 34 | centering abutment |
| 35 | centering abutment |
| 36 | centering bore |
| 37 | centering bore |
| 38 | worm gear |
| 39 | worm |
| 44' | workpiece abutment |
| 45' | workpiece abutment |

What is claimed is:

1. A method of machining crankshaft-like workpieces with one machine, said method comprising the following steps:

machining both concentric and eccentric rotationally symmetrical surfaces of the workpiece by means of material removing wherein the workpiece includes at least one side and rotationally symmetrical surfaces which are arranged both concentrically and eccentrically with respect to a central axis of the workpiece clamping the workpiece on a central axis and driving the workpiece rotationally in all machining steps on the central axis of the workpiece;

machining the concentric rotationally symmetrical surfaces of the workpiece according to a desired cutting speed which is achieved primarily by the rotational speed of a workpiece; and machining when desired the eccentric rotationally symmetrical surfaces of the workpiece according to a cutting speed produced primarily by rotational movement of a tool;

selectively driving the workpiece from only one end at high speeds of rotation if machined according to a desired cutting speed being achieved by a rotational speed of the workpiece and from the other end at low speeds of rotation and maintaining defined rotational positions of the workpiece around the axis of rotation of at least one spindle according to a cutting speed produced primarily by rotational movement of a tool.

2. A method as set forth in claim 1 wherein said eccentric, rotationally symmetrical workpiece surfaces are machined according to a cutting speed which is achieved primarily by the rotational speed of a workpiece which are lower by at least a factor of 10 than when using a cutting speed produced primarily by rotational movement of tool.

3. A method as set forth in claim 1 wherein said crankshaft-like workpieces has at least one end portions that is machined.

4. A method as set forth in claim 3 wherein when machining said at least one end portions, one end portion is machined according to a desired cutting speed which is achieved primarily by the rotational speed of a workpiece and the other end portion is machined at a speed of workpiece rotation lower by at least a factor of 10 by means of a drive from the end of the workpiece driven at a low speed of rotation.

5. A method as set forth in claim 3 wherein said at least one end portion is an end journal and the other end portion is an end flange of an outside diameter substantially larger than the end journal and the workpiece is driven at a high speed of rotation from the end flange.

6. A method as set forth in claim 3 wherein said machining of said at least one end portions is effected prior to the concentric, rotationally symmetrical surfaces, and after machining of the end portions the peripheral surface of at least one of the end portions is used for clamping and/or driving purposes.

7. A method as set forth in claim 1 wherein said eccentric rotationally symmetrical surfaces are machined prior to the concentric rotationally symmetrical surfaces.

8. A method as set forth in claim 1 wherein the high speeds of rotation of a workpiece during the machining operation are speeds of rotation of between 40 rpm and 1600 rpm and low speeds of rotation of the workpiece are between 0.1 rpm and 40 rpm.

9. A method as set forth in claim 1 wherein a high drive torque of a workpiece during the machining operation is drive torques of between 600 N×m and 3000 N×m and a low drive torque for the workpiece is drive torques of between 200 N×m and 600 N×m.

10. A method as set forth in claim 8 wherein cutting speeds are in the range of between 150 m/s and 700 m/s.

11. A machine for machining concentric and eccentric, rotationally symmetrical surfaces of workpieces having a plurality of ends by mechanical material removal, said machine comprising:

a bed;

two oppositely directed, rotationally driven spindles for receiving and driving the ends of a workpiece about a longitudinal direction an Z-axis;

at least one tool support which is definedly displaceable at least in an X-direction one spindle is driven at a high speed of rotation and the other spindle is driven at a low speed of rotation and is capable of moving to defined rotational positions (C'-axis); and at least one of the spindles has a rotational position-directing axis.

12. A machine as set forth in claim 11 wherein said at least one tool support in addition to being displaceable in said X-direction, is displaceable either in the Y-direction or is pivotally moveable about said Z-direction (C2-axis.

13. A machine as set forth in claim 11 wherein the rotational drive for said low speed rotational spindle is a self-locking rotational drive.

14. A machine as set forth in claim 11 wherein one of said at least one tool supports of which one carriers at least one tool for workpieces-based machining methods wherein the desired cutting speed is achieved primarily by the rotational speed of the workpiece being selected from the group consisting of a turning tool, a broaching tool, a rotational broaching tool, a turning-rotational broaching tool and a finishing tool, and another of said at least one tool support carries at least one tool for a tool-based machining method wherein the cutting speed is produced primarily by the rotational movement of the tool being selected from the group consisting of an orthogonal milling cutter and an externally toothed milling cutter.

15. A machine as set forth in claim 11 wherein the drives of said spindles are uncoupleable.

16. A machine as set forth in claim 11 wherein said spindles are driven from the same motor.

17. A machine as set forth in claim 14 wherein said at least one tool is arranged on at least one disk-shaped main tool body at an external periphery and at least one tool for tool-based methods wherein the cutting speed is produced primarily by the rotational movement of the tool is arranged distributed over an entire periphery of the main tool body.

18. A machine as set forth in claim 14 wherein said machine is provided with tools of different materials selected from the group consisting of material which are intended for high cutting speeds above 180 m/s on the one hand and low cutting speeds, a maximum of 180 m/s on the other hand with hard metal, carbide metal, ceramic cutting materials and high-speed steel (HSS) on the other hand.

19. A machine as set forth in claim 11 wherein said machine has only a single tool support on which is arranged tools for high cutting speeds and tools low cutting speeds, which are tools for workpiece-based machining methods wherein the desired cutting speed is achieved primarily by the rotational speed of the workpiece.

20. A machine as set forth in claim 11 wherein at least one of the spindles has on the one hand a jaw chuck for clamping at an external periphery and on the other hand a centering point which is movable relative to a jaw chuck in a Z-direction.

21. A machine as set forth in claim 20 wherein said centering point is free-runningly rotatably supported.

22. A machine as set forth in claim 20 wherein said centering point can be axially fixed in a defined Z-position with respect to said jaw chuck.

23. A machine as set forth in claim 20 wherein said at least one spindle has a longitudinal abutment for said Z-position of said centering point with respect to said jaw chuck or with respect to said at least one spindle or a longitudinal abutment of the workpiece with respect to said jaw chuck.

24. A machine as set forth in claim 20 wherein axial forces to which said centering points can be subjected are adjustable in respect of whether the respective axial force is greater or smaller than the axial force acting on the other centering point.

* * * * *